US010987562B2

(12) United States Patent
Klett

(10) Patent No.: US 10,987,562 B2
(45) Date of Patent: Apr. 27, 2021

(54) HOCKEY SHOOTER TUTOR

(71) Applicant: Kurtis P. Klett, Faribault, MN (US)

(72) Inventor: Kurtis P. Klett, Faribault, MN (US)

( * ) Notice: Subject to any disclaimer, the term of this patent is extended or adjusted under 35 U.S.C. 154(b) by 70 days.

(21) Appl. No.: 14/864,046

(22) Filed: Sep. 24, 2015

(65) Prior Publication Data

US 2016/0082338 A1 Mar. 24, 2016

Related U.S. Application Data

(60) Provisional application No. 62/054,703, filed on Sep. 24, 2014.

(51) Int. Cl.

| | |
|---|---|
| ***A63B 69/00*** | (2006.01) |
| ***A63B 63/00*** | (2006.01) |
| *A63B 102/24* | (2015.01) |

(52) U.S. Cl.

CPC ..... *A63B 69/0026* (2013.01); *A63B 63/00* (2013.01); *A63B 63/004* (2013.01); *A63B 69/0097* (2013.01); *A63B 2063/002* (2013.01); *A63B 2102/24* (2015.10); *A63B 2209/00* (2013.01); *A63B 2210/50* (2013.01); *A63B 2225/09* (2013.01)

(58) Field of Classification Search

CPC ..... A63B 69/0024; A63B 69/0026
USPC ..... 473/446, 478, 450
See application file for complete search history.

(56) References Cited

U.S. PATENT DOCUMENTS

| | | | | |
|---|---|---|---|---|
| 3,840,228 | A * | 10/1974 | Greaney | A63B 63/00 273/127 B |
| 3,856,298 | A * | 12/1974 | Frantti | A63B 63/00 273/127 R |
| D309,486 | S * | 7/1990 | Guenette | D21/699 |
| D387,111 | S * | 12/1997 | Delegarde | D21/699 |
| 6,012,994 | A * | 1/2000 | Beluse | A63B 69/0026 473/446 |
| 8,187,123 | B2 * | 5/2012 | Pettys | A63B 63/00 273/402 |
| 2007/0265115 | A1 * | 11/2007 | Farquhar | A63B 63/004 473/446 |
| 2009/0149281 | A1 * | 6/2009 | Johnson | A63B 69/34 473/447 |

* cited by examiner

*Primary Examiner* — Eugene L Kim
*Assistant Examiner* — Rayshun K Peng
(74) *Attorney, Agent, or Firm* — Johnson and Phung LLC; Thomas N. Phung

(57) ABSTRACT

A once-piece hockey puck-training device for improving hockey puck shooting comprising a hockey goalie panel mannequin having a 2-dimensional shape similar to a shape of a hockey goalie in a butterfly style position with the hockey goalie panel mannequin constructed from a manipulated durable material characterized to produce a rebound of a hockey puck which ricochets off the mannequin simulating the rebound of a hockey puck which rebounds from a hockey goalie, the hockey goalie panel mannequin securable to a hockey goal post to form a right shoulder target slot, a left shoulder target slot, a right lower arm target slot, a left lower shoulder target slot, and a between the legs/skates target slot with the target slots shaped and sized to mimic the typical scoring areas when a hockey goalie is tending a net in the "butterfly style" technique.

18 Claims, 3 Drawing Sheets

HOCKEY SHOOTER TUTOR

CROSS REFERENCE TO RELATED APPLICATIONS

This application claims priority to U.S. Provisional Application Ser. No. 62/054,703, which was filed on Sep. 24, 2014; tiled HOCKEY SHOOTER TUTOR.

FIELD OF THE INVENTION

This invention relates generally to the sport of hockey and, more specifically to a device that train hockey players to develop their hockey puck shooting techniques in order to improve the player's hockey puck distance shooting accuracy and hockey puck rebound-shooting accuracy.

STATEMENT REGARDING FEDERALLY SPONSORED RESEARCH OR DEVELOPMENT

None

REFERENCE TO A MICROFICHE APPENDIX

None

BACKGROUND OF THE INVENTION

Shooting targets and shooting tarps are well known in the art and are used to help train hockey players to develop their hockey puck shooting techniques and accuracy. These aforementioned shooting targets and shooting tarps are typically constructed from a flexible canvas material and/or nylon with typically circular-shaped holes cut out in the corners and five circular-shaped holes for receiving hockey pucks therethrough. The shooting targets and shooting tarps are usually installed on any regulation size hockey net by ropes or bungee cords. Although the shooting targets and shooting tarps function for their intended purposes they do have many limitations. For example since traditional shooting targets and shooting tarps are usually made from canvas and/or nylon they tend to have durability issues stemming from exposure to high velocity strikes of the hockey pucks. In addition, the bungee cords and ropes attaching the shooting targets and shooting tarps to the net will break if hit by pucks enough times. Attaching and detaching the shooting targets and shooting tarps to and from the net can also be a time consuming process. Shooting target, with their traditional circular-shaped targets, does not provide their users with real-life simulated shooting targets as the shooting targets or open net space on a live goalie is not your typical circular-shaped targets. And finally, since the shooting targets and shooting tarps are constructed from canvas and/or nylon, they do not give a realistic or natural rebound similar to the rebounding of a puck that occurs with a live goalie.

In ice hockey, a "butterfly style" is a technique of goaltending distinguished by the goaltender guarding the lower part of the net by dropping to the knees to block attempts to score. The butterfly style derives its name from the resemblance of the spread goal pads and hands to a butterfly's wings. The butterfly style is contrasted with stand-up style, where most shots on a goal are stopped with the goaltender on his or her feet. Due to it's effectiveness in blocking traditional shooting zones and it's adaption by current professional hockey goalies, the "butterfly style" technique has become a de facto standard style of play today. Two of the main characteristics of the butterfly style are that (1) it can leave the upper portion of the net more vulnerable to scoring attempts and (2) there are typically more puck rebounds.

The present inventions attempts to resolve the various shortcomings of the traditional the shooting targets and shooting tarps while provide shooting training for the "butterfly style" technique by providing a goalie panel mannequin that not only mimics the shape and sizes of the vulnerable shooting zones of the "butterfly style" technique but also is constructed of a durable material that provides a realistic or natural rebound similar to the rebounding of the puck that occurs with a live goalie to also help hockey players improve their hockey puck rebound and shooting techniques and accuracy.

SUMMARY OF THE INVENTION

The present invention a hockey puck-training device for improving hockey puck shooting comprising a hockey goalie panel mannequin having a 2-dimensional shape similar to a shape of a hockey goalie in a butterfly style position. The hockey goalie panel mannequin is constructed from a manipulated durable material characterized to produce a rebound of a hockey puck, which ricochets off the mannequin simulating the rebound of a hockey puck, which rebounds from a hockey goalie. The hockey goalie panel mannequin is securable to a hockey goal post to form a right shoulder target slot, a left shoulder target slot, a right lower arm target slot, a left lower arm target slot, and a between the legs/skates target slot with the target slots shaped and sized to mimic the typical scoring areas when a hockey goalie is tending a net in the "butterfly style".

In regards to the target slots, in order to mimic live hockey goalie targets, in one embodiment the right shoulder target slot comprises a shape of a space formed between a goalie's neck and right shoulder region and a right goal post corner when a goalie is tending a net in the butterfly position. The left shoulder target slot comprises a shape of a space formed between a goalie's neck and left shoulder region and a left goal post corner when the goalie is tending the net in the butterfly position. The right lower arm target slot comprises a shape of a space formed between a goalie's lower right arm, midsection, and upper right thigh and the right goal post when the goalie is tending the hockey net in the butterfly position. The left lower arm target slot comprises a shape of a space formed between a goalie's lower left arm, midsection, and upper left thigh and the left goal post when the goalie is tending the hockey net in the butterfly position. The between the legs/skates target slot comprises a shape of a space formed between a goalie's skates and a goalie's groin region when the goalie is tending the hockey net in the butterfly position.

DESCRIPTION OF THE PREFERRED EMBODIMENT

Figure 1:
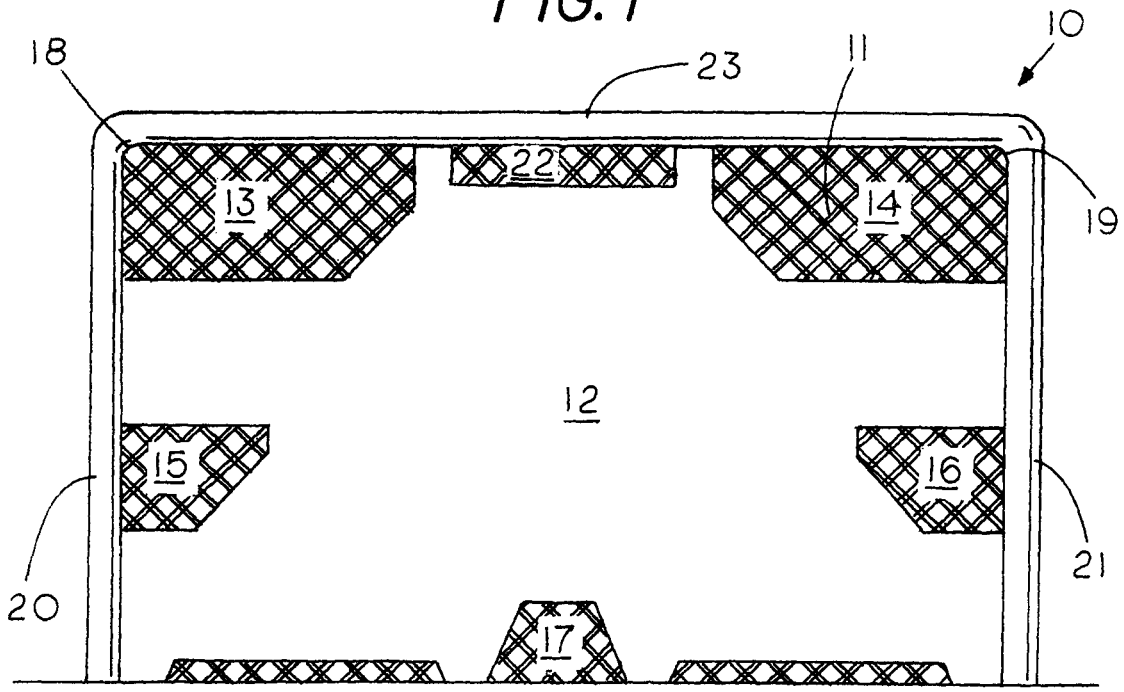
FIG. 1 is a front view showing and embodiment of a one-piece hockey shooter tutor of the present invention.

FIG. 1 is a front view showing a one-piece hockey shooter tutor 10 of the present invention that is attached to a regulation size hockey net 11. The hockey shooter tutor 10 comprises a hockey goalie panel mannequin 12 having a 2-dimensional shape similar to a shape of a real-life hockey goalie in a butterfly style position. The hockey goalie panel mannequin 12 preferably is constructed from a durable material that provides a realistic or natural hockey puck rebound similar to the rebounding of the puck that occurs with a live goalie to also help hockey players improve their hockey puck rebound skills including puck shooting techniques and shooting accuracy. In addition, providing for a realistic or natural hockey puck rebound similar to the rebounding of the puck that occurs with a live goalie also allows for the training of multiple hockey players with the present invention such as for example training various skating formations with a shooter and multiple players attacking the net for rebounding shots.

Example of suitable materials include but is not limited to high durability Plexiglas, various polymer plastics, harden rubber, various forms of wood, and the like which is manipulated to enable the hockey puck to rebound similar to the rebounding of the puck that occurs with a live goalie.

In the embodiment of FIG. 1, when attached to the regulation size hockey net 11, the goalie panel mannequin 12 forms a right shoulder target slot 13, a left shoulder target slot 14, a right lower arm target slot 15, a left lower shoulder target slot 16, and a between the legs/skates target slot 17, which corresponds to the typical scoring areas when a hockey goalie is tending a net in the "butterfly style" technique. In the embodiment of FIG. 1 the width of the between the legs/skates target slot 17 preferably tapers upward. For example between the legs/skates target slot 17 may comprise a lower width of 12 inches and an upper with of 6 inches and a height of 6 inches. It is noted that alternative embodiments may comprise a between the legs/skates target slot 17 of varying width(s), and heights.

In specific regards to the respective target slots, it is noted that a feature of the present invention is that the target slots 13, 14, 15, 16, 17 are not standard or random circular, rectangular, and/or square-shaped geometrical slots/targets but instead are designed to closely resemble the target slots of a real hockey goalie situated in the "butterfly style" technique when positioned in front of the goalie net. Providing users/hockey players with real-life simulated shooting targets will allow for improve player's performance and comfort during real game-time play as the hockey players would already have been used to shoot at the target slots of the real hockey goalie and know exactly what to look for when shooting the puck. That is, the right shoulder target slot 13 comprises a shape similar to the shape of a space formed between a goalie's neck and right shoulder region and a right goal post corner 18 when the goalie is in the butterfly position. The left shoulder target slot 14 comprises a shape similar to the shape of a space formed between a goalie's neck and left shoulder region and a left goal post corner 19 when the goalie is in the butterfly position.

The right lower arm target slot 15 comprises a shape similar to the shape of a space formed between the goalie's lower right arm, midsection, and upper right thigh and the right goal post 20 when the goalie is in the butterfly position. Similarly, the left lower arm target slot comprises a shape similar to the shape of a space formed between the goalie's lower left arm, midsection, and upper left thigh and the left goal post 21 when the goalie is in the butterfly position. The between the legs/skates target slot 17 comprises a shape similar to the shape of a space formed between the goalie's skates and the goalie's groin region when the goalie is in the butterfly position.

The embodiment of FIG. 1 also includes top shelf slot 22 comprising a shape similar to the shape of a space formed between the goalie's helmet and an upper goal post 23 when the goalie is in the butterfly position.

Another feature of the present invention, as partially shown in the embodiment of FIG. 1, is that the size of the target slots may be adjustable so that the hockey shooter tutor of the present invention may be tailored to hockey players of varying skill levels. For example, in the embodiment of FIG. 1, the width of right shoulder target slot 13 and left shoulder target slot 14 may be adjusted to change from as large as 24 inches to zero inches, which mimics the movement of the hockey goalie between the hockey posts.

Although only the size of the right lower arm target slot 13 and the left lower arm target slot 14 of FIG. 1 are shown as having the capabilities of being adjustable, alternative embodiments of the present invention may include the sizes of all of the target slots having the capabilities of being adjustable.

Figure 2:
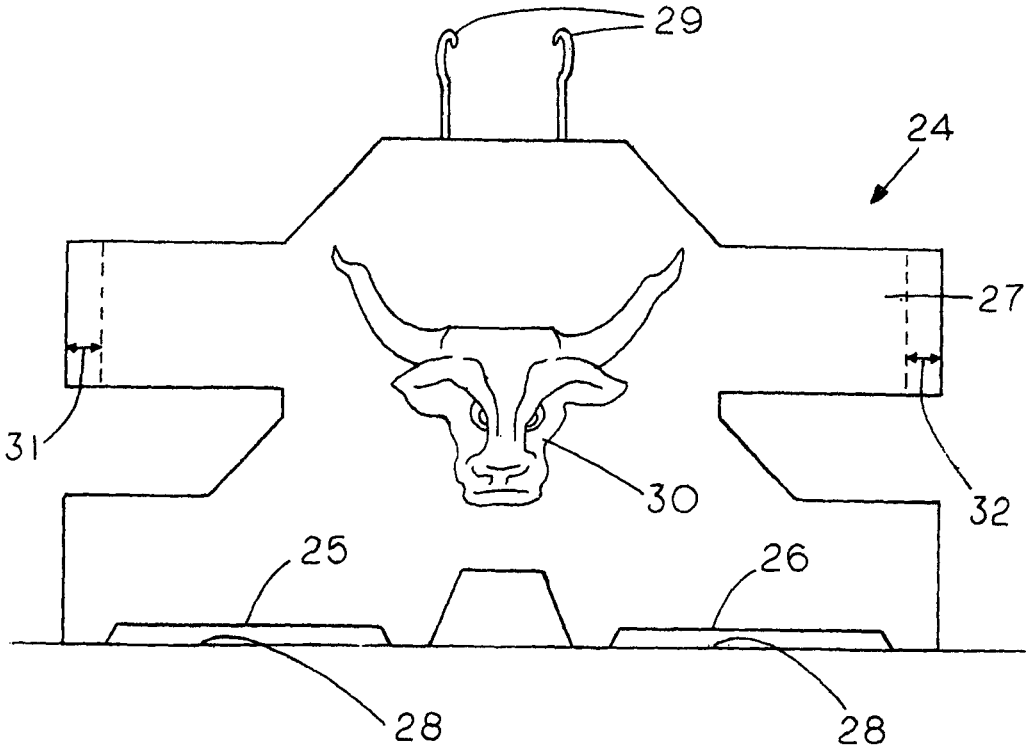
FIG. 2 is a front view showing a one-piece hockey shooter tutor that includes a pair of hangers and a design or logo located on the hockey goalie panel mannequin.

FIG. 2 is a front view showing a one-piece hockey shooter tutor 24 of the present invention similar to the hockey shooter tutor 10 of FIG. 1. However, the embodiment of FIG. 2 also includes a right floor slot 25 located between a lower right region of a hockey goalie panel mannequin 27 and an ice or ground surface 28 and a left floor slot 26 located between a lower left region of the hockey goalie panel mannequin 27 and the ice or ground surface 28. Although the right and left floor slots 25 and 26 may vary in length, the height of both the right and left floor slots 25, 26 are specifically sized to receive a moving hockey puck that either glides on the ice sheet therethrough or similar thereto to help train hockey players with alternative shooting style and/or puck shooting control. A feature of the present invention is that the right and left floor slots enable the user to sweep pucks that goes through the hockey shooter tutor out through the bottom slots with a stick.

The hockey shooter tutor 24 of FIG. 2 is shown to also include a pair of hangers 29 to assist in securing the hockey goalie panel mannequin 27 to the upper goal post 23 (shown in FIG. 1) of the hockey net. Although hockey shooter tutor 24 is shown with the use of pair of hangers 29, alternative embodiments may comprise the use of no hangers to a plurality of hangers. The embodiment of FIG. 2 is shown to further include a design or logo 30 located on the hockey goalie panel mannequin 27. Although the design 30 shown in FIG. 2 comprises a team mascot, alternative designs may include but is not limited to a hockey goalie or team logo.

The hockey shooter tutor 24 of FIG. 2 also includes an adjustable right arm length 31 and an adjustable left arm length 32 to train hockey players to shoot at the spaces formed between the right goal post 20 and the right arm of the goalie and the left goal post 21 and the left arm of the goalie.

Figure 3:
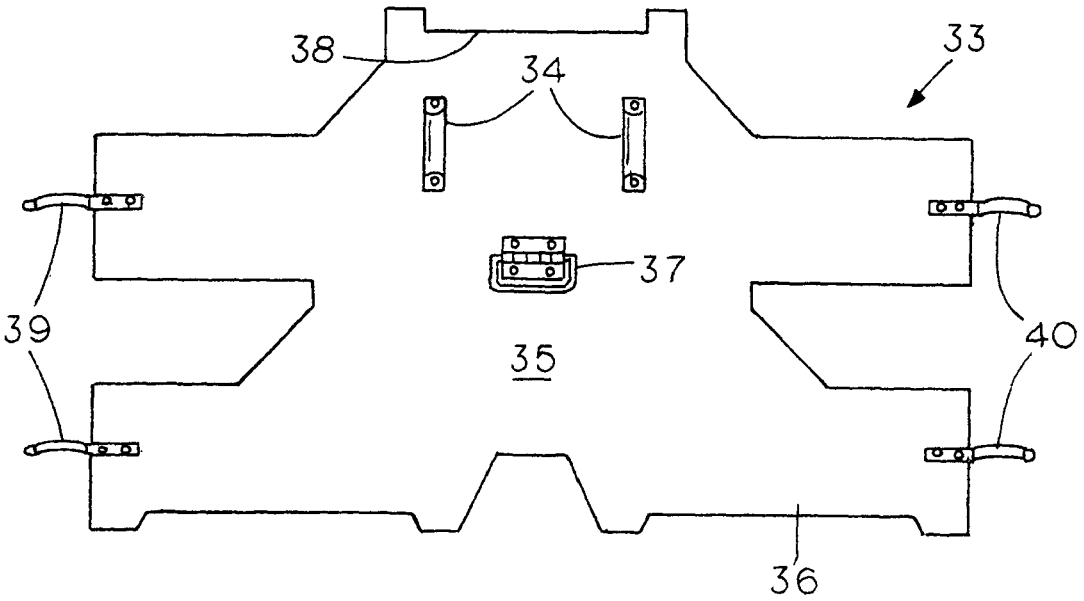
FIG. 3 is a back view showing an alternative embodiment of a one-piece hockey shooter tutor.

FIG. 3 is a back view showing an alternative embodiment of a one-piece hockey shooter tutor 33 similar to the hockey shooter tutors of FIGS. 1 and 2. The embodiment of FIG. 3 is shown to include a pair of carrying handles 34 located on a backside 35 of a hockey goalie panel mannequin 36 to assist a user in carrying and handling the hockey shooter tutor 33. A feature of the carrying handles 34 is that the carrying handles 34 are sized to enable hockey gloves to fit therein. The hockey shooter tutor of FIG. 3 also includes a hanger 37 centrally located on the backside of the hockey goalie panel mannequin for either hanging the hockey shooter tutor 33 for storage or for hanging the hockey shooter tutor 33 for use on a wall surface.

The hockey shooter tutor 33 of FIG. 3 further includes a top shelf slot 38 located between the top of the goalie's head or the top section of the hockey goalie panel mannequin 36 and the top cross bar of the goalie net for receiving puck shots therethough.

The hockey shooter tutor 33 of FIG. 3 also includes a first or left pair of hooks 39 and a second or right pair of hooks 40 for quick attachment and detachment of the hockey shooter tutor to any standard or regulation size hockey net compared to the traditional canvas style shooting targets and shooting tarps as there are no strings or bungee cords to tie and untie.

Figure 4:
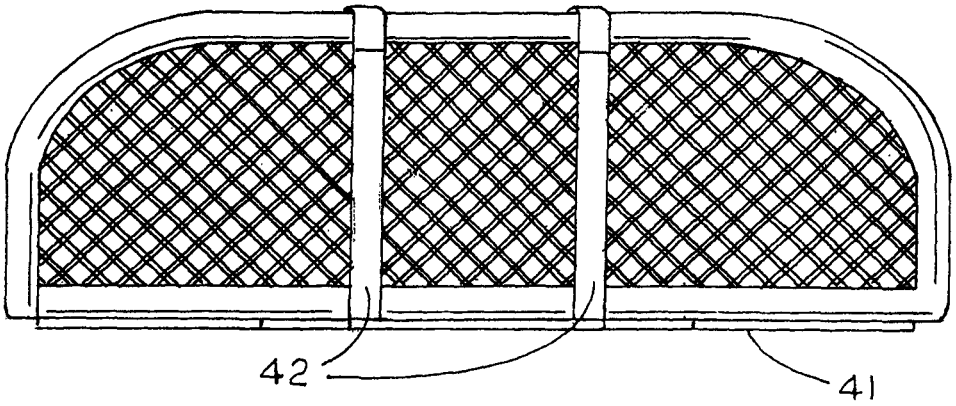
FIG. 4 is a top view showing an alternative embodiment of a hockey shooter tutor having a pair of adjustable straps connecting the hockey shooter tutor to a hockey net.

FIG. 4 is a top view showing an alternative embodiment of a one-piece hockey shooter tutor 41 of the present invention having a pair of adjustable straps 42 for either assisting the handling and connection of the hockey shooter tutor 41 to the hockey net and/or hanging the hockey shooter tutor 41 for storage. Although each of the adjustable straps 42 may be narrower or wider in alternative embodiments, in the embodiment of FIG. 4 the pair of adjustable straps 42 each comprises a width of 3 inches and may have the characteristics similar to that of automobile seat belt buckling system. Alternative embodiments of the present invention may comprise the use of one strap to a plurality of straps.

Figure 5:
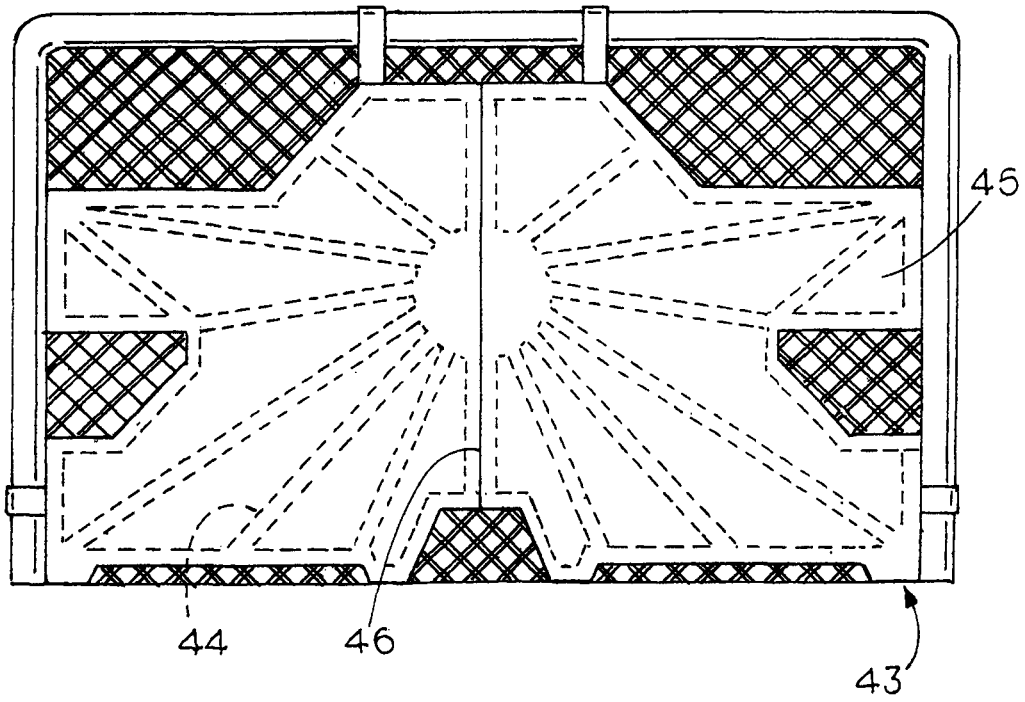
FIG. 5 is a front view showing a foldable hockey shooter tutor having a skeletal frame.

FIG. 5 is a front view showing an alternative embodiment of a foldable hockey shooter tutor 43 of the present invention. Foldable hockey shooter tutor 43 includes a skeletal frame 44 supporting a hockey goalie panel mannequin 45 thereon.

One of the features of skeletal frame 44 is that skeletal frame 44 not only provides structural support to foldable hockey shooter tutor 43 but reduce the overall weight of foldable hockey shooter tutor 43 by reducing the amount of material required in the manufacturing of foldable hockey shooter tutor 43.

Skeletal frame 44 also allows the user to customize the various attributes of skeletal frame 44. For example, changes to the type of materials or the thickness of the materials supported by skeletal frame 44 will influence the characteristics such as speed and angle of the rebound produced by the ricocheting of the hockey puck off of foldable hockey shooter tutor 43.

Foldable hockey shooter tutor 43 also includes a pivotal hinge 46 preferably extending mid-way across the hockey shooter tutor 43 to allow for the hockey shooter tutor 43 to be folded in half for improving transportability.

I claim:

1. A one-piece hockey puck-training device for improving hockey puck shooting comprising:

a hockey goalie panel mannequin having a 2-dimensional shape having a perimeter similar to a perimeter of a shape of a live hockey goalie in a butterfly style position, said hockey goalie panel mannequin constructed from a manipulated durable material characterized to produce a rebound of a hockey puck which ricochets off said mannequin simulating the rebound of a hockey puck which rebounds from a hockey goalie, said hockey goalie panel mannequin securable to a hockey goal post to form a right shoulder target slot having a shape and size similar to a shape and size of a space having a perimeter formed from said live goalie's neck and right shoulder region and a right goal post corner when said live goalie is tending a net in said butterfly position with each of said sides of said right shoulder target slot having a different length and a side sloping against said right shoulder region of said hockey goalie panel mannequin, a left shoulder target slot having a shape and size similar to a shape and size of a space having a perimeter formed from said live goalie's neck and left shoulder region and a left goal post corner when said live goalie is tending said net in said butterfly position with each of said sides of said left shoulder target slot having a different length and a side sloping against said left shoulder region of said hockey goalie panel mannequin, a right lower arm target slot having a shape and size similar to a shape and size of a space having a perimeter formed from said live goalie's lower right arm, midsection, and upper right thigh and said right goal post when said live goalie is tending said net in said butterfly position with each of said sides of said right lower target slot having a different length and a side sloping against said upper right thigh of said hockey goalie panel mannequin, a left lower arm target slot having a shape and size similar to a shape and size of a space having a perimeter formed from a goalie's lower left arm, midsection, and upper left thigh and the left goal post when said live goalie is tending said net in said butterfly position with each of said sides of said left lower target slot having a different length and a side sloping against said upper left thigh of said hockey goalie panel mannequin, a between the legs/skates target slot having a shape and size similar to a shape and size of a space having a perimeter formed from said live goalie's skates, said live goalie's groin region, and a ground surface when said live goalie is tending said net in said butterfly position, a right floor slot having a shape and size similar to a shape and size of a space having a perimeter formed from a lower right region of said live goalie and said ground surface when said live goalie is tending said net in said butterfly position, and a left floor slot having a shape and size similar to a shape and size of a space having a perimeter formed from a lower left region of said live goalie and said ground surface when said live goalie is tending said net in said butterfly position with said right shoulder target slot, said right lower arm target slot, said right floor slot, and said between the legs/skates target slot each comprises a different shape and size;

said target slots shaped and sized to mimic the typical scoring areas when a hockey goalie is tending a net in the "butterfly style" technique.

2. The one-piece hockey puck-training device of claim 1 wherein a width of said between the legs/skates target slot said right floor slot, and said left floor slot each tapers upward.

3. The one-piece hockey puck-training device of claim 1 wherein said hockey goalie panel mannequin comprises a high durability Plexiglas, various polymer plastics, or harden rubber manipulated to produce a rebound of a hockey puck which ricochets off said mannequin simulating the rebound of a hockey puck which rebounds from a hockey goalie.

4. The one-piece hockey puck-training device of claim 1 including a top shelf slot comprising a shape of a space having a perimeter formed from a goalie's helmet and an upper goal post when the goalie is tending said net in the butterfly position.

5. The one-piece hockey puck-training device of claim 1 wherein the size of each of said target slots is adjustable to be tailor to hockey players of varying skill levels.

6. The one-piece hockey puck-training device of claim 1 including a pair of hangers securing said hockey goalie panel mannequin to an upper goal post of a hockey net.

7. The one-piece hockey puck-training device of claim 1 wherein said hockey goalie panel mannequin includes an adjustable right arm length and an adjustable left arm length.

8. The one-piece hockey puck-training device of claim 1 including a pair of carrying handles located on a backside of said hockey goalie panel mannequin to assist a user in carrying and handling said hockey goalie panel mannequin, said carrying handles sized for supporting hockey gloves therein.

9. The one-piece hockey puck-training device of claim 1 including a hanger centrally located on a backside of said hockey goalie panel mannequin for transporting and for hanging the hockey shooter tutor for storage or for hanging the hockey shooter tutor for use on a wall surface, said hanger sized for supporting hockey gloves therein.

10. The one-piece hockey puck-training device of claim 1 including a pair of hooks located on a left side of said hockey goalie panel mannequin and a second pair of hooks located on a right side of said hockey goalie panel mannequin for quick attachment and detachment of the hockey goalie panel mannequin to a hockey net.

11. A hockey puck-training device for improving hockey puck shooting comprising:

a hockey goalie panel mannequin having a 2-dimensional shape having a perimeter similar to a perimeter of a shape of a live hockey goalie in a butterfly style position, said hockey goalie panel mannequin constructed from a manipulated durable material characterized to produce a rebound of a hockey puck which ricochets off said mannequin simulating the rebound of a hockey puck which rebounds from a hockey goalie, said hockey goalie panel mannequin securable to a hockey goal post to form a right shoulder target slot having a shape and size similar to a shape and size of a space having a perimeter formed from said live goalie's neck and right shoulder region and a right goal post corner when said live goalie is tending a net in said butterfly position with each of said sides of said right shoulder target slot having a different length and a side sloping against said right shoulder region of said hockey goalie panel mannequin, a left shoulder target slot having a shape and size similar to a shape and size of a space having a perimeter formed from said live goalie's neck and left shoulder region and a left goal post corner when said live goalie is tending said net in said butterfly position with each of said sides of said left shoulder target slot having a different length and a side sloping against said left shoulder region of said hockey goalie panel mannequin, a right lower arm target slot having a shape and size similar to a shape and size of a space having a perimeter formed from said live goalie's lower right arm, midsection, and upper right thigh and said right goal post when said live goalie is tending said net in said butterfly position with each of said sides of said right lower target slot having a different length and a side sloping against said upper right thigh of said hockey goalie panel mannequin, a left lower arm target slot having a shape and size similar to a shape and size of a space having a perimeter formed from said live goalie's lower left arm, midsection, and upper left thigh and the left goal post when said live goalie is tending said net in said butterfly position with each of said sides of said left lower target slot having a different length and a side sloping against said upper left thigh of said hockey goalie panel mannequin, a between the legs/skates target slot having a shape and size similar to a shape and size of a space having a perimeter formed from said live goalie's skates, said live goalie's groin region and an ice surface when said live goalie is tending said net in said butterfly position with a width of said between the legs/skates target slot tapering upward from said ice surface, a top shelf slot having a shape and size similar to a shape and size of a space having a perimeter formed from said live goalie's helmet and an upper goal post when the live goalie is tending said net in the butterfly position, a right floor slot having a shape and size similar to a shape and size of a space having a perimeter formed from a lower right region of said live goalie and said ice surface when said live goalie is tending said net in said butterfly position and a left floor slot having a shape and size similar to a shape and size of a space having a perimeter formed from a lower left region of live goalie and said ice surface when said live goalie is tending said net in said butterfly position with said right shoulder target slot, said right lower arm target slot, said right floor slot, and said between the legs/skates target slot each comprises a different shape and size.

12. The hockey puck-training device of claim 11 wherein the size of each of said target slots is adjustable to be tailor to hockey players of varying skill levels.

13. The hockey puck-training device of claim 12 including a weight-reducing skeletal frame supporting said hockey goalie panel mannequin thereon, said skeletal frame providing structural support to said hockey goalie panel mannequin.

14. The hockey puck-training device of claim 13 including a pivotal hinge extending mid-way across said hockey goalie panel mannequin, said pivotal hinge allowing said hockey goalie panel mannequin to be folded in half for improving transportability.

15. The hockey puck-training device of claim 14 including a hanger securing said hockey goalie panel mannequin to an upper goal post of a hockey net.

16. The hockey puck-training device of claim 15 wherein said hockey goalie panel mannequin includes an adjustable right arm length and an adjustable left arm length.

17. The hockey puck-training device of claim 14 including a pair of hooks located on a left side of said hockey goalie panel mannequin and a second pair of hooks located on a right side of said hockey goalie panel mannequin for quick attachment and detachment of the hockey goalie panel mannequin to a hockey net.

18. A hockey puck-training device for improving hockey puck shooting comprising:

a hockey goalie panel mannequin having a 2-dimensional shape having a perimeter similar to a perimeter of a shape of a live hockey goalie in a butterfly style position, said hockey goalie panel mannequin constructed from a high durability Plexiglas, various polymer plastics, or harden rubber characterized to produce a rebound of a hockey puck which ricochets off said mannequin simulating the rebound of a hockey puck which rebounds from said live hockey goalie;

said hockey goalie panel mannequin includes an adjustable right arm length and an adjustable left arm length;

said hockey goalie panel mannequin securable to a hockey goal post to form a right shoulder target slot having a shape and size similar to a shape and size of a space having a perimeter formed from said live goalie's neck and right shoulder region and a right goal post corner when said live goalie is tending a net in said butterfly position with each of said sides of said right shoulder target slot having a different length and a side sloping against said right shoulder region of said hockey goalie panel mannequin, a left shoulder target slot having a shape and size similar to a shape and size of a space having a perimeter formed from said live goalie's neck and left shoulder region and a left goal post corner when said live goalie is tending said net in said butterfly position with each of said sides of said left shoulder target slot having a different length and a side sloping against said left shoulder region of said hockey goalie panel mannequin, a right lower arm target slot comprising an irregular polygon shape of a space having a shape and size similar to a shape and size of a space having a perimeter formed from said live goalie's lower right arm, midsection, and upper right thigh and said right goal post when said live goalie is tending said net in said butterfly position with each of said sides of said right lower target slot having a different length and a side sloping against said upper right thigh of said hockey goalie panel mannequin, a left lower arm target slot comprising an irregular polygon shape of a space having a shape and size similar to a shape and size of a space having a perimeter formed from said live goalie's lower left arm, midsection, and upper left thigh and the left goal post when said live goalie is tending said net in said butterfly position with each of said sides of said left lower target slot having a different length and a side sloping against said upper left thigh of said hockey goalie panel mannequin, a between the legs/skates target slot having a shape and size similar to a shape and size having a perimeter formed from said live goalie's skates, said live goalie's groin region and an ice surface when said live goalie is tending said net in said butterfly position with a width of said between the legs/skates target slot tapering upward from said ice surface, a top shelf slot having a shape and size similar to a shape and size having a perimeter formed from said live goalie's helmet and an upper goal post when the live goalie is tending said net in the butterfly position, a right floor slot having a shape and size similar to a shape and size of a space having a perimeter formed from a lower right region of said live goalie and said ice surface when said live goalie is tending said net in said butterfly position and a left floor slot having a shape and size similar to a shape and size of a space having a perimeter formed from a lower left region of said live goalie and said ice surface when said live goalie is tending said net in said butterfly position with said right floor slot and said left floor slot each having a height from said ice surface to an opposing side of said slot that requires a hockey pluck to glide on said ice surface in order to pass therethough;

said right shoulder target slot, said right lower arm target slot, said right floor slot, and said between the legs/skates target slot each comprises a different shape and size; and a weight-reducing skeletal frame supporting said hockey goalie panel mannequin thereon, said skeletal frame providing structural support to said hockey goalie panel mannequin.

* * * * *